US006518832B2

(12) United States Patent
Enriquez

(10) Patent No.: US 6,518,832 B2
(45) Date of Patent: Feb. 11, 2003

(54) MECHANISM FOR MINIMIZING CURRENT MIRROR TRANSISTOR BASE CURRENT ERROR FOR LOW OVERHEAD VOLTAGE APPLICATIONS

(75) Inventor: Leonel Ernesto Enriquez, Melbourne Beach, FL (US)

(73) Assignee: Intersil Americas Inc., Irvine, CA (US)

( * ) Notice: Subject to any disclaimer, the term of this patent is extended or adjusted under 35 U.S.C. 154(b) by 0 days.

(21) Appl. No.: 09/901,439

(22) Filed: Jul. 9, 2001

(65) Prior Publication Data

US 2003/0006826 A1 Jan. 9, 2003

(51) Int. Cl.[7] ..... G05F 1/10
(52) U.S. Cl. ..... 327/538; 323/315
(58) Field of Search ..... 327/538, 540, 327/543; 323/315

(56) References Cited

U.S. PATENT DOCUMENTS 3,813,607 A * 5/1974 Voorman ..... 323/315
4,412,186 A * 10/1983 Nagano ..... 323/316
4,462,005 A * 7/1984 Kusakabe et al. ..... 330/288
5,311,146 A * 5/1994 Brannon et al. ..... 323/315
5,473,243 A * 12/1995 Thomas ..... 323/315
6,087,819 A * 7/2000 Kuroda ..... 323/315

* cited by examiner

*Primary Examiner*—Terry D. Cunningham
(74) *Attorney, Agent, or Firm*—Allen, Dyer, Doppelt, Milbrath & Gilchrist, P.A.

(57) ABSTRACT

To mitigate against base current errors in a current mirror circuit that has limited overhead voltage, a compensated current mirror circuit includes a complementary polarity base current error reduction and auxiliary turn-on circuit, that provides an overhead voltage that enjoys a base-emitter diode drop improvement over the overhead voltage of a conventional circuit. Due to the base current error-reduction transistor in the circuit path from the power supply rail to the input port, the overhead voltage is improved by a base-emitter diode drop larger than the overhead voltage of the conventional circuit. In addition, it further reduces base current error.

7 Claims, 1 Drawing Sheet

MECHANISM FOR MINIMIZING CURRENT MIRROR TRANSISTOR BASE CURRENT ERROR FOR LOW OVERHEAD VOLTAGE APPLICATIONS

FIELD OF THE INVENTION

The present invention relates in general to electronic circuits, and is particularly directed to new and improved current mirror circuit architecture for minimizing transistor base current errors or offsets in a low voltage application such as, but not limited to the, coupling of a subscriber line interface circuit to a low voltage codec.

BACKGROUND OF THE INVENTION

Systems employed by telecommunication service providers contain what are known as subscriber line interface circuits or 'SLIC's, to interface communication signals with tip and ring leads of a wireline pair that serves a relatively remote piece of subscriber communication equipment. In order that they may be interfaced with a variety of telecommunication circuits, including those providing codec functionality, present day SLICs must conform with a very demanding set of performance requirements, including accuracy, linearity, insensitivity to common mode signals, low noise, low power consumption, filtering, and ease of impedance matching programmability.

Indeed, using differential voltage-based implementations, designers of integrated circuits employed for digital communications, such as codecs and the like, have been able to lower the voltage supply rail requirements for their devices (e.g., from a power supply voltage of five volts down to three volts). As a result, the communication service provider is presented with the problem that such low voltage restrictions may not provide sufficient voltage headroom to accommodate a low impedance-interface with existing SLICs (which may be designed to operate at a VCC supply rail of five volts).

This limited voltage headroom problem may be illustrated by considering the design and operation of a conventional current mirror architecture, such as that shown in FIG. 1, which is of the type that may be employed in a subscriber line interface circuit, being designed to operate with a customary VCC supply rail of five volts. In this conventional current mirror design, an input NPN transistor 10 has its base 11 coupled to a voltage reference $V_{REF}$, and its emitter 12 coupled to receive an emitter current $I_{12}$ or input current $I_{in}$, from a device, such as a codec.

The collector 13 of the input NPN transistor 10 is coupled in common to the collector 23 of a first current mirror input PNP transistor 20, and to the base 31 of a base current compensator PNP transistor 30, the collector 33 of which is coupled to a voltage reference terminal, such as ground (GND). The emitter 32 of the base current compensator PNP transistor 30 is coupled in common to the base 21 of the current mirror input transistor 20 and to the base 41 of a PNP current mirror output transistor 40. The emitters 22 and 42 of current mirror transistors 20 and 40, respectively, are coupled through resistors 24 and 44 to a (VCC) voltage supply rail 16, while the collector 43 of the current mirror output transistor 40 is coupled to an output terminal 45, from which an output current $I_{out}$ is derived.

Although working reasonably well when operating at a designed power supply rail voltage VCC of five volts, the current mirror of FIG. 1 lacks sufficient overhead for proper circuit operation with a reduced voltage circuit, such as a differential voltage-based codec operating at a much smaller VCC rail value (e.g., on the order of only three volts and a reference voltage $V_{REF}$ of only half that). In addition, even though the mirrored output $I_{out}$ at the output node 45 is first order compensated for PNP base current errors, it is not compensated for the NPN base current error in the input transistor 10.

More particularly, the mirrored output current $I_{out}$ at the current mirror's output terminal 45 corresponds to the collector current $I_{43}$ flowing out of the collector 43 of the current mirror output transistor 40 which, for equal geometry current mirror input and output transistors and equal value resistors 24 and 44, may be defined as:

$$I_{out}=I_{43}=\alpha_{NPN10}I_{12}-2I_{12}/\beta_{PNP}^{2},$$

or $$I_{out}=I_{12}(\alpha_{NPN10}-2/\beta_{PNP}^{2}).$$

Therefore, for all practical purposes the value of the mirrored output current $I_{out}$ may be approximated as:

$$I_{out}=I_{in}(1-1/\beta_{NPN}). \quad (1)$$

From equation (1), it can be seen that the mirrored output current $I_{out}$ at the collector 43 of the current mirror output transistor 40 not only includes the desired input current $I_{in}$, but contains an undesired base current error component $I_{in}/\beta_{NPN}$ associated with the NPN input transistor 10. Due to the extremely tight voltage tolerances associated with the use of the substantially lower VCC supply rail voltage and reference voltage $V_{REF}$, there is no available headroom in the collector-emitter current flow path through transistors 10–20 and the VCC supply rail for insertion of an NPN base current error compensating transistor.

In an alternative architecture, the input transistor 10 is removed, so that the input is applied directly to the collector 23 of the current mirror input transistor 20. However, this does not resolve the base current error problem, since the overhead voltage at the input (the collector 23 of the current mirror input transistor 20) is still two base-emitter diode voltage drops ($Vbe_{20}+Vbe_{30}$) below VCC.

In this case the mirrored output current may be defined as:

$$I_{out}=I_{in}(1-1/\beta_{p}^{2}). \quad (2)$$

SUMMARY OF THE INVENTION

In accordance with the present invention, the above-described base current error problem is successfully addressed by a multiple transistor polarity (PNP and NPN) base current error reduction and auxiliary turn-on circuit architecture, that provides an overhead voltage that enjoys a base-emitter diode drop improvement over the overhead voltage of a conventional circuit. As in the conventional current mirror architecture of FIG. 1, the improved base current error minimizing current mirror circuit architecture of present invention couples the base of the current mirror input transistor to the emitter of a base current compensator transistor.

However, rather than having its base connected directly to the collector of the current mirror input transistor, the base current compensator transistor has its base coupled to the emitter of an opposite polarity base current error-reduction transistor. This base current error-reduction transistor has its collector coupled to the VCC supply rail, and its base coupled to the collector of the current mirror input transistor, to which the current mirror's input terminal is coupled.

The emitter of the base current error-reduction transistor is further coupled to the collector of the base current compensator transistor through an auxiliary biasing and turn-on circuit including a pull down transistor pair. In addition, a diode is coupled between the base current compensator transistor and the input port, and serves to ensure that the circuit turns on in the presence of a slowly ramping power supply.

Due to the presence of the base current error-reduction transistor in the circuit path from the power supply rail to the input port, the overhead voltage is improved by a base-emitter diode drop when compared to the overhead voltage of the conventional circuit. In addition, the presence of the auxiliary biasing circuit allows for further reduction of the base current error, as will be described.

DETAILED DESCRIPTION

Figure 2:
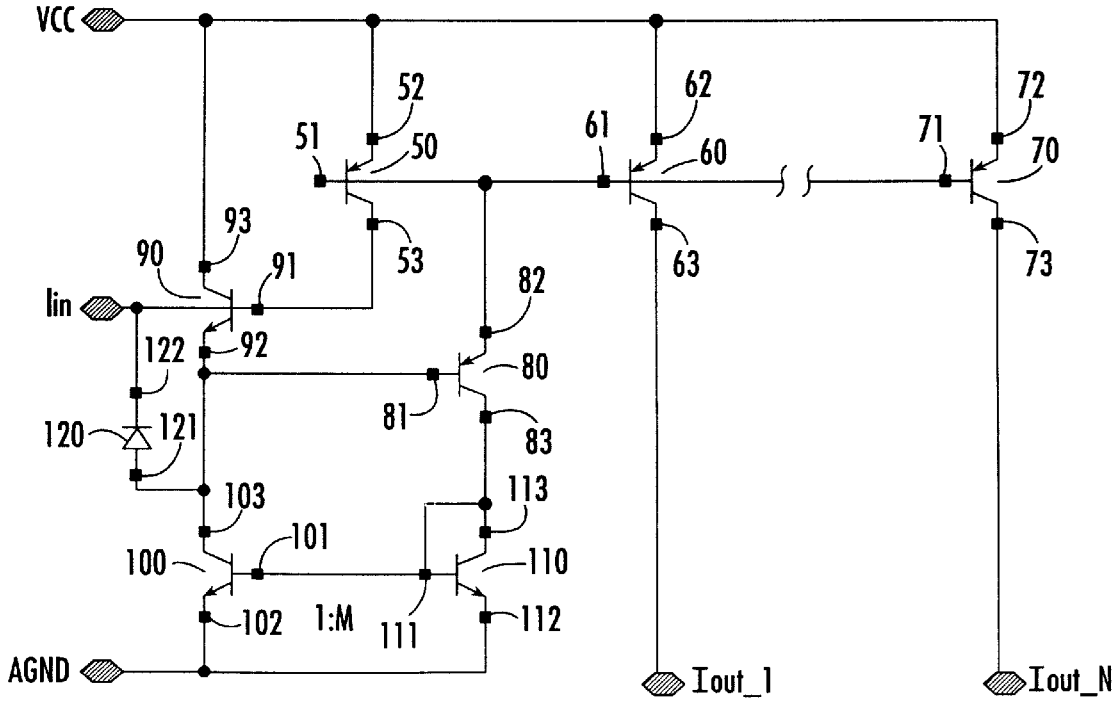
FIG. 2 is a schematic illustration of a current mirror circuit employing the base current error minimization scheme of the present invention.

Attention is now directed to FIG. 2 which schematically shows a current mirror circuit employing the base current error minimization scheme of the present invention. For purposes of providing a non-limiting example, the current mirror of FIG. 2 is configured as a PNP output current mirror transistor-based circuit, with its input interfaced to an associated signaling circuit (e.g., codec). It should be understood, however, that the polarities of the transistors may be reversed (with an associated reversal in biasing voltage rails) without a loss in generality.

Moreover, the example of FIG. 2 is shown as having a current input port Iin, that is adapted to be coupled to a relatively low voltage device, such as a codec, and first and second current output ports Iout_1 and Iout_2 from which respective output currents $I_{out_1}$ and $I_{out2}$ are derived. It should be understood, however, that the invention is not limited to use with any a particular number of ports. A two output port circuit has been illustrated in order to reduce the complexity of the drawings. From the description of the illustrated two port device, to follow, the application of the base current error minimization mechanism of the invention to an N output port device is readily determined.

The base current error minimizing current mirror circuit architecture of FIG. 2 includes a bipolar PNP input current mirror transistor 50, having its base 51 coupled to the base 61 of a first bipolar PNP output current mirror transistor 60 and to the base 71 of a second bipolar NPN output current mirror transistor 70. The respective emitters 52, 62 and 72 of transistors 50, 60 and 70 are coupled to the power supply rail VCC. Although not explicitly shown, resistors may be installed in the VCC power supply coupling paths of the current mirror transistor emitters.

The first current mirror output transistor 60 has its collector 63 coupled to the first current output port Iout_1, while the second current mirror output transistor 70 has its collector 73 coupled to the second current output port Iout_2. The output currents produced at the output currents $I_{out_1}$ and $I_{out2}$ are proportional to the geometry ratios of the output transistors 60 and 70 to the current mirror input transistor 50.

Figure 1:
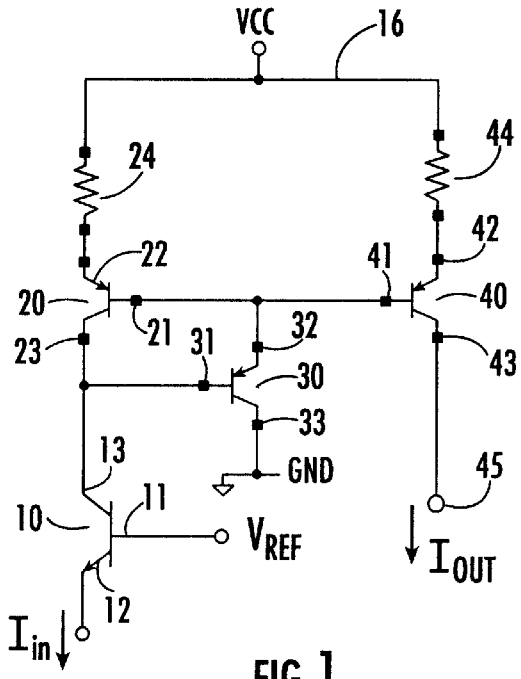
FIG. 1. (PRIOR ART)
FIG. 1 is a schematic illustration of a conventional current mirror circuit in which the mirrored output current is first order compensated for PNP base current errors.

As in the conventional current mirror architecture of FIG. 1, the base 51 of the current mirror input transistor 50 is further coupled to the emitter 82 of a base current compensator PNP transistor 80. However, rather than having its base 81 connected directly to the collector 53 of the current mirror input transistor 50, PNP transistor 80 has its base coupled to the emitter 92 of an NPN base current error-reduction transistor 90. NPN base current error-reduction transistor 90 and base current compensator PNP transistor 80 form a buffer circuit between the current mirror and an input terminal Iin, to which an input current $I_{in}$ is coupled.

The NPN transistor 90 has its base 91 coupled to collector 53 of the current mirror input transistor 50, and its collector 93 is coupled to the VCC supply rail. The emitter 92 of NPN transistor 90 is further coupled to the collector 103 of an NPN transistor 100, the base 101 of which is coupled in common with the collector 113 and base 111 of an associated diode-connected current mirror transistor 110. The emitter 102 of NPN transistor 100 and the emitter 112 of NPN transistor 110 are coupled to ground (AGND). The collector 113 of transistor 110 is coupled to the collector 83 of base current compensator PNP transistor 80. In addition, a diode 120 has its anode 121 coupled to the emitter 92 of NPN base current error-reduction transistor 90 and its cathode 122 coupled to the input port Iin. Diode 120 serves to ensure that the circuit turns on in the presence of a slowly ramping power supply.

An examination of the circuit of FIG. 2, in particular the circuit path through the buffer circuit transistors 80 and 90, reveals that the installation of the NPN base current error-reduction transistor 90 results in an overhead voltage Vovrhd of:

$$Vovrhd=VCC-Vbe_{PNP50}-Vbe_{PNP80}+Vbe_{NPN90}. \quad (3)$$

For equal geometries of like polarity devices, equation (3) may be rewritten as:

$$Vovrhd=VCC-2Vbe_p+Vbe_N, \quad (4)$$

which is at least a base-emitter diode drop larger than the overhead voltage of the conventional circuit of FIG. 1. This improvement in overhead voltage, although somewhat modest, may be of critical importance in reduced power supply rail applications (e.g., three volts or less).

As pointed out previously, in addition to improving the overhead voltage, the circuit of FIG. 2 may be configured to substantially reduce base current error. In particular, for N output transistors with identical geometries to the input current mirror transistor 50, the output current $I_{out_i}$ at an arbitrary output node Iout_i may be defined as:

$$I_{out_i}\approx I_{in}(1-(N+1)/(M\beta_P\beta_N)). \quad (5)$$

where M is the emitter area ratio of transistors 110 and 100.

As will be appreciated from the above description, the base current error problem of a conventional SLIC-installed current mirror circuit (that does not have sufficient voltage supply headroom to accommodate compensation circuit components) is effectively minimized by the multiple transistor polarity (PNP and NPN) base current error reduction and auxiliary bias circuit architecture of the invention, that provides an overhead voltage that enjoys a base-emitter diode drop improvement over the overhead voltage of a conventional circuit. Due to the base current error-reduction transistor in the circuit path from the power supply rail to the input port, the overhead voltage is improved by a base-emitter diode drop with respect to the overhead voltage-of the conventional circuit. In addition, it further reduces base current error.

While I have shown and described an embodiment in accordance with the present invention, it is to be understood that the same is not limited thereto but is susceptible to numerous changes and modifications as known to a person skilled in the art. I therefore do not wish to be limited to the details shown and described herein, but intend to cover all changes and modifications as are obvious to one of ordinary skill in the art.

What is claimed is:

1. A current mirror circuit comprising:

an input port adapted to receive an input current;

an output port adapted to provide an output current therefrom:

a first polarity current mirror input transistor having an input electrode coupled to said input port, an output electrode coupled to a power supply terminal, and a control electrode coupled to a control electrode of a first polarity current mirror output transistor, which is operative to supply said output current to said output port in accordance with said input current;

a first polarity compensation transistor having an input electrode coupled to control electrodes of said current mirror input and output transistors, an output electrode coupled to a reference voltage terminal, and a control electrode coupled to an output electrode of a second polarity compensation transistor, said second polarity compensation transistor having an input electrode coupled to said power supply terminal and a control electrode coupled to said input electrode of said first polarity current mirror input transistor; and an auxiliary turn-on circuit coupled to said first and second polarity compensation transistors, said auxiliary turn-on circuit including two second polarity transistors respectively coupled between said reference voltage terminal and said first and second polarity compensation transistors.

2. A current mirror circuit according to claim 1, wherein said auxiliary turn-on circuit further includes a diode coupled in circuit with said input port and said first and second polarity compensation transistors.

3. A current mirror circuit according to claim 1, wherein said current mirror circuit is configured of bipolar transistors.

4. A current mirror circuit comprising:

an input port adapted to receive an input current;

an output port adapted to provide an output current therefrom:

a first polarity bipolar current mirror input transistor having a collector coupled to said input port, an emitter coupled to a power supply terminal, and a base coupled to a base of a first polarity bipolar current mirror output transistor, from a collector of which a mirrored output current is supplied to said output port in accordance with said input current;

a first polarity bipolar compensation transistor having an emitter coupled to bases of said current mirror input and output transistors, a collector coupled to a reference voltage terminal, and a base coupled to an emitter of a second polarity bipolar compensation transistor, said second polarity bipolar compensation transistor having a collector coupled to said power supply terminal and a base coupled to the collector of said a first polarity bipolar current mirror input transistor; and an auxiliary turn-on circuit coupled to said input port and to said first and second polarity bipolar compensation transistors, said auxiliary turn-on circuit including two second polarity bipolar transistors respectively coupled between said reference voltage terminal and said first and second polarity bipolar compensation transistors, and a diode coupled in circuit with said input port and said first and second polarity bipolar compensation transistors.

5. A method of generating an output current in accordance with an input current comprising the steps of:

(a) coupling said input current to an input electrode of a first polarity current mirror input transistor having an output electrode coupled to a power supply terminal, and a control electrode coupled to a control electrode of a first polarity current mirror output transistor, said first polarity current mirror output transistor being operative to supply said output current to said output port in accordance with said input current; and (b) providing first and second polarity compensation transistors, such that an input electrode of said first polarity compensation transistor is coupled to control electrodes of said current mirror input and output transistors, an output electrode of said first polarity compensation transistor is coupled to a reference voltage terminal, and a control electrode of said first polarity compensation transistor is coupled to an output electrode of said second polarity compensation transistor, and such that said second polarity compensation transistor has an input electrode coupled to said power supply terminal and a control electrode coupled to said input electrode of said first polarity current mirror input transistor; and (c) coupling an auxiliary turn-on circuit to said first and second polarity compensation transistors, said auxiliary turn-on circuit including two second polarity transistors respectively coupled between said reference voltage terminal and said first and second polarity compensation transistors.

6. A method according to claim 5, wherein said auxiliary turn-on circuit further includes a diode coupled in circuit with said input port and said first and second polarity compensation transistors.

7. A method according to claim 5, wherein said current mirror circuit is configured of bipolar transistors.

* * * * *